US005524652A

United States Patent [19]

Neubauer

[11] Patent Number: 5,524,652

[45] Date of Patent: Jun. 11, 1996

[54] APPARATUS FOR CLEANING METALLIC WORKPIECES

[75] Inventor: Wilhelm Neubauer, Vienna, Austria

[73] Assignee: Aichelin Industrieofenbau GmbH, Modling, Austria

[21] Appl. No.: 250,165

[22] Filed: May 27, 1994

[30] Foreign Application Priority Data

May 28, 1993 [DE] Germany ..... 43 17 862.6

[51] Int. Cl.[6] ..... B08B 3/10

[52] U.S. Cl. ..... 134/95.2; 134/96.1; 134/97.1; 134/98.1; 134/102.2; 134/103.1; 134/108; 134/109

[58] Field of Search ..... 134/95.2, 96.1, 134/97.1, 98.1, 102.2, 102.3, 103.1, 107, 108, 109

[56] References Cited

U.S. PATENT DOCUMENTS

| | | | |
|---|---|---|---|
| 2,567,820 | 9/1951 | Messerschmidt . | |
| 2,843,137 | 7/1958 | Federichi et al. | 134/102.3 X |
| 3,460,990 | 8/1969 | Barday . | |
| 3,601,135 | 8/1971 | Marlow et al. | 134/103.1 X |
| 4,061,504 | 12/1977 | Zall et al. | 134/98.1 X |
| 5,011,542 | 4/1991 | Weil . | |
| 5,045,117 | 9/1991 | Witherell | 134/109 X |
| 5,082,535 | 1/1992 | Oesch et al. | 134/109 X |
| 5,106,425 | 4/1992 | Sluga et al. . | |
| 5,137,581 | 8/1992 | Takahashi . | |
| 5,143,103 | 9/1992 | Basso et al. . | |
| 5,268,035 | 12/1993 | Neubauer et al. . | |
| 5,268,036 | 12/1993 | Neubauer et al. . | |

FOREIGN PATENT DOCUMENTS

| | | |
|---|---|---|
| 3009313 | 9/1980 | Germany . |
| 9013241 | 9/1990 | Germany . |
| 9217047 | 12/1992 | Germany . |
| 6061404 | 10/1986 | Japan . |
| 16488389 | 2/1991 | Japan . |
| 1135181 | 12/1968 | United Kingdom . |
| 2028293 | 3/1980 | United Kingdom . |
| 8908163 | 9/1989 | WIPO . |
| WO9308933 | 5/1993 | WIPO . |

*Primary Examiner* Philip R. Coe
*Attorney, Agent, or Firm* Kokjer, Kircher, Bowman & Johnson

[57] ABSTRACT

A method and an apparatus serve for treating workpieces with a treating liquid, in particular for cleaning metallic workpieces prior to a heat-treatment to be performed thereafter. The workpieces are introduced into a washing vessel. The washing vessel is then closed air-tight. A vacuum is then generated in the washing vessel. Further, a duct is opened between the washing vessel and a tank containing the treating liquid. For filling the washing vessel, the vacuum is adjusted to a level such that the treating liquid is drawn into the washing vessel under the action of the vacuum.

11 Claims, 1 Drawing Sheet

APPARATUS FOR CLEANING METALLIC WORKPIECES

BACKGROUND OF THE INVENTION

1. Field of the Invention

The present invention relates generally to the field of treating workpieces with a treating liquid. More specifically, the invention relates to an apparatus for cleaning metallic workpieces prior to a heat-treatment to be performed thereafter.

2. Prior Art

U.S. Pat. Nos. 5,268,035 and 5,268,036 disclose methods and apparatuses for cleaning, inter alia, metallic workpieces. The disclosure of these two U.S. patent specifications is herewith incorporated herein by reference.

According to this prior art method and apparatus metallic workpieces are cleaned in a washing vessel. For this purpose, the washing vessel is filled by means of a pressureless splash douche mounted under the washing vessel cover. A pressureless flow of washing liquid emerging from the splash douche flows over the workpieces arranged below the douche. This process is continued until a desired filling level of the liquid is reached in the washing vessel.

During one of the subsequent cleaning steps, the air space left in the washing vessel above the liquid is evacuated until a vacuum below the saturation steam pressure of the liquid is attained. In this way it is possible to cause the liquid to start boiling, and have the workpieces treated by rising steam bubbles at a temperature substantially below 100° C.

According to the prior art apparatus, a certain amount of equipment and instrumentation is required for filling the washing vessel and then performing the various cleaning steps.

It is, therefore, an object underlying the present invention to improve an apparatus of the type specified at the outset such as to permit the filling equipment and instrumentation to be simplified and, hence, reduce costs.

SUMMARY OF THE INVENTION

The present invention eliminates the shortcomings of the prior art by suggesting a method and an apparatus for treating workpieces with a treating liquid.

Further, the claimed apparatus comprises:

a washing vessel;

means for supporting said workpieces within said washing vessel;

means for air-tight closing said washing vessel;

a tank for receiving said treating liquid;

first duct means interconnecting said washing vessel and said tank and having valve means therein for opening and closing said first duct means, respectively;

means for establishing a vacuum within said washing vessel when closed air-tight; and control means for controlling said valve means and said vacuum establishing means for generating a vacuum in said washing vessel and opening said first duct means so as to draw said treating liquid from said tank into said washing vessel under the action of said vacuum.

The object underlying the present invention is thus fully achieved.

For, the invention takes advantage, very elegantly, of the fact that it is anyway possible to produce a considerable vacuum in the washing vessel by means of the vacuum pump. But if this is the case, then this vacuum can also be used for drawing the treating liquid into the washing vessel, when the washing vessel is evacuated and empty. If one proceeds in this way, one can do without a separate pump for filling the washing vessel because the vacuum pump is utilized in this manner not only for provoking the boiling of the treating liquid at a temperature clearly below 100° C., but also for filling the washing vessel.

It is evident that this reduces considerably the necessary input of equipment and instrumentation. The "vacuum boiling" technology can be used in this manner also in connection with devices that are available at clearly lower prime cost, whereby the field of application is clearly enlarged for the method according to the invention.

Given the fact that it is also known, in connection with the cleaning of metallic workpieces, to employ a vacuum method for final drying of the workpieces, which means that the still wet, but warm workpieces are exposed to a low-pressure atmosphere, the necessary vacuum pump can therefore be utilized for a total of three functions, namely for drawing in the treating liquid, for generating the necessary vacuum to achieve boiling at a temperature below 100° C., and finally for the vacuum drying process.

According to a preferred development of the invention, the liquid is drawn in through a connection in the bottom area of the washing vessel. In the case of the device according to the invention, the line connection opens for this purpose into the tank near the latter's bottom.

This feature provides the advantage that further cost savings are rendered possible because a separate douche for filling in the treating liquid is no longer needed. Instead, the washing vessel outlet anyway available is now simultaneously used as inlet opening in that slides or other arrangements, together with the necessary lines, are controlled in a suitable way. In some applications, where no initial cleaning of the workpieces by means of a pressureless splash or by means of a high-pressure jet is needed, one can even do without a separate douche.

According to another embodiment of the invention, the liquid is drawn in via a splash douche arranged above the workpieces in the washing vessel. In the case of the device according to the invention, this is achieved by the fact that the line connection opens in the washing vessel into a splash douche arranged above the workpieces.

This feature provides the advantage that pre-cleaning of the workpieces using a splash douche is rendered possible for numerous applications in the manner known, for example, from DE-PS 41 38 400.

According to another embodiment of the invention, the vacuum is generated by the fact that air is drawn off the washing vessel and guided through condensing means. The device according to the invention comprises for this purpose a vacuum line that is connected to the washing vessel and, via condensing means, to a vacuum pump.

This feature provides the advantage that it allows the recovery of any treating liquid contained in the extracted air in the form of vapor.

It is therefore possible, according to the invention, to have the condensed liquid separated from the extracted air in the condensing means, and then returned into the tank. This is effected with the device according to the invention by the fact that a condensed-liquid collecting vessel, that is part of the condensing means, can be connected to the tank.

This feature provides the advantage that the treating liquid remains confined within a closed circuit and will not thicken as a result of constant vapor evacuation.

According to still another embodiment of invention, the tank is ventilated, during the transfer of liquid from the tank into the washing vessel, by the air escaping from the condensing means. This is achieved in the device according to the invention by the fact that the tank-ventilation line is connected with the outlet of the vacuum pump.

This feature provides the advantage that the air present above the liquid in the tank is at all times kept humid, by means of the vapor produced by the liquid itself, so that no excessive vaporization of the liquid can occur in the tank.

Additional advantages of the invention will become obvious from the description and the attached drawing.

It is understood that the features mentioned above and those yet to be explained below can be utilized not only in the respective combinations indicated, but also in other combinations or in isolation, without leaving the context of the present invention.

The invention will now be described in more detail with reference to the one embodiment illustrated in the drawing.

DESCRIPTION OF THE PREFERRED EMBODIMENT

Figure 1:
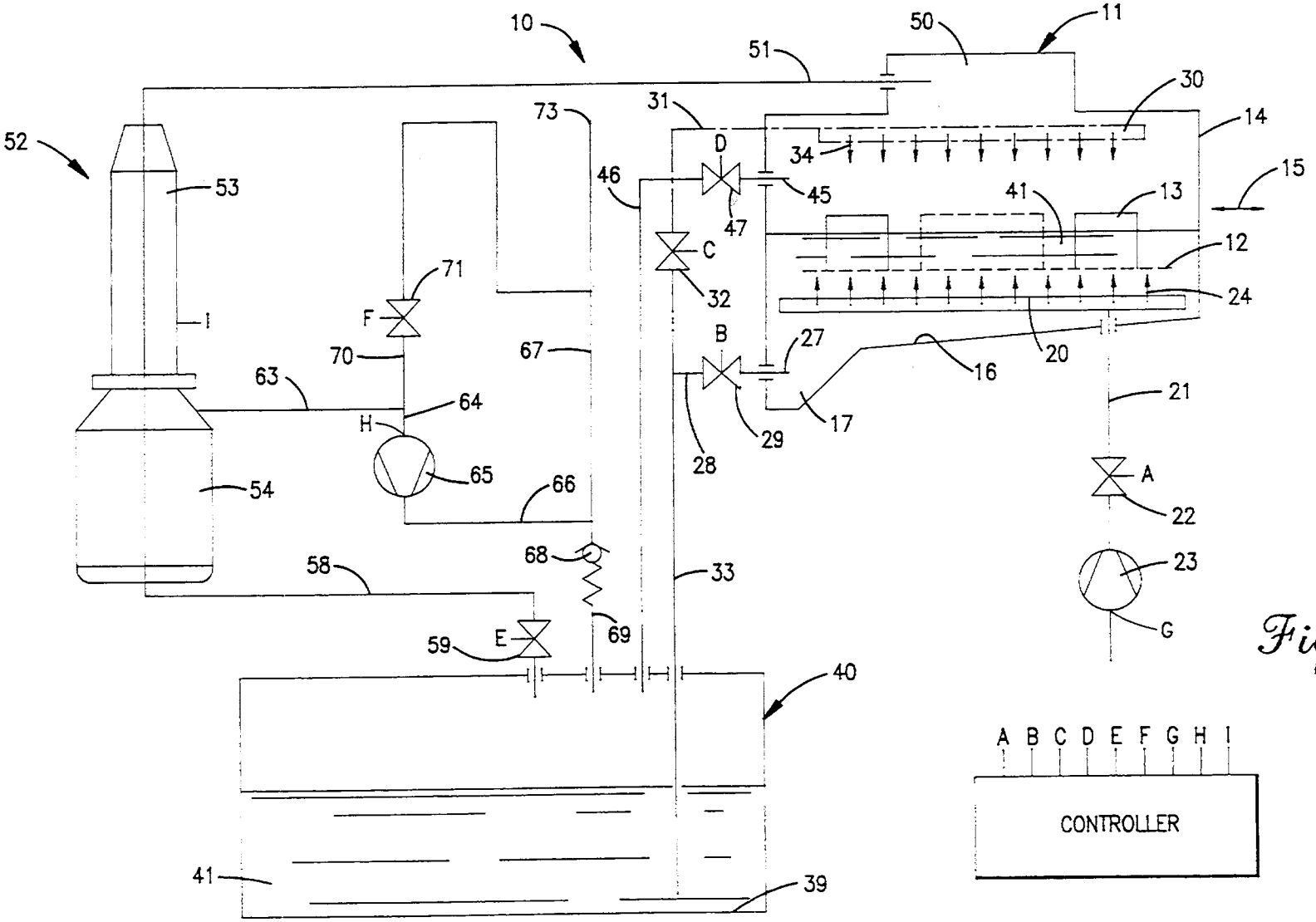
FIG. 1 shows a very diagrammatic block diagram of one embodiment of the device according to the invention that may also serve as reference for the description of the method according to the invention.

Regarding the figure, a device for cleaning metallic workpieces is indicated generally by reference numeral 10. It should be noted, however, at this point that the device according to the invention is not limited to the particular case of cleaning metallic workpieces, but that it can be used also in numerous other cases where workpieces have to be treated with a liquid.

Further details are disclosed in the two U.S. Pat. Nos. 5,268,035 and 5,268,036 mentioned at the outset and incorporated herein by reference.

The device 10 comprises a washing vessel 11 which is of the horizontal type in the illustrated embodiment.

The washing vessel 11 contains a holder 12 for workpieces 13. A door 14 is arranged on the side of the tank in the case of the present horizontal design, so that the workpieces 13 can be loaded into, and discharged from the tank through the door 14, as indicated by double-arrow 15.

A bottom 16 of the washing vessel 11 has a slightly inclined configuration and terminates at its lowest point by a trough 17, indicated only diagrammatically, in order to facilitate draining of the washing vessel 11.

A hollow body 20 arranged at the bottom of the washing vessel 11 is connected with a blower 23 via a pressure line 21 and a valve 22. The hollow body 20 is provided with a plurality of small bores. When the blower 23 is started, air bubbles will emerge from the hollow body, as indicated by arrows 24. The air bubbles rise inside the washing vessel 11 and flow around the workpieces 13, during which process any dirt particles and the like adhering to the workpieces are entrained by the air bubbles.

The process of blowing in air is known as such and is described in the art as "flotation".

A line 28 is connected with the washing vessel 11 via a connection 27 in the trough 17. Inserted in the line 28 is a valve 29.

In the upper part of the washing vessel 11, there is located a splash douche 30, connected to a line 31 in which a valve 32 is inserted. The lines 28 and 31 join in a common line 33. In operation of the splash douche 30, a pressureless splash of liquid emerges from the douche, as indicated in the figure by arrows 34.

The common line 33 runs to a point near the bottom 39 of the tank 40 that contains the treating liquid 41.

Inside the washing vessel 11, there is further provided, at about medium height, an overflow 45 that is connected to a line 46. Inserted in the line 46 is a valve 47. The line 46 also leads to the tank 40.

The upper portion of the washing vessel 11 is configured in the form of a hood 50. A line 51 opens into the hood 50. The line 51 is connected with condensing means 52, namely a condenser 53 which latter is connected to a collecting vessel 54 for the condensed liquid.

A line 58 leads from the collecting vessel 54 via a valve 59 and then also to the tank 40. A line 63 runs from the condenser 53 to a junction point which is connected to an intake inlet of a vacuum pump 65, via a line 64. The pressure outlet of the vacuum pump 65 is connected to a line 67 via a line 66. The line 67 leads on the one hand via a non-return valve 68 and a line 69 to the tank 40, and on the other hand to an exhaust 73.

The operation of the device 10 is as follows:

To start a washing operation, one initially loads the washing vessel 11 with workpieces 13 through the door 14, whereafter the door 14 is closed pressure-tight.

Now, the remote-controllable valves, that normally are configured as solenoid valves, are operated via an electronic control—illustrated schematically as having control lines A–I for controlling correspondingly designated elements of apparatus 10.

For filling the washing vessel 11, the valves 22, 47, 59 and 71 are closed, and the valve 29 is opened. Alternatively, or additionally to the valve 29, the valve 32 located in the line 31, as indicated in dash-dotted lines, may also be opened.

If the vacuum pump 65 is switched on in this condition, it will take in air from the interior of the washing vessel 11, via the line 51, the condenser 53 and the lines 63 and 64. If and to the extent any residual liquid, in the form of vapor, is still present in the intake air, it is separated in the condenser 53 and transferred into the collecting vessel 54. Upon completion of the filling operation, or at the end of the vacuum boiling process with subsequent atmospheric pressure compensation, the condensed liquid is returned into the tank 40, via the line 58 and the valve 59.

The outlet air of the vacuum pump 65 is guided through the lines 66 and 67 and to the exhaust 73. The air present at the point where the line 66 joins the line 67 and, therefore, at the inlet of the non-return valve 68 is, thus, saturated.

As a result of the vacuum forming inside the washing vessel 11, liquid 41 is now drawn from the tank 40, when the valve 29 is in its open position. The liquid flows through the line 33, the line 28 and the valve 29, to the connection 27 and from there into the washing vessel 11, in the area of the trough 17. As the vacuum continues to exist in the washing vessel 11, additional liquid 41 is drawn into the washing vessel 11 until a predetermined liquid level is reached.

Due to the fact that liquid 41 is extracted from the tank 40, the tank needs to be ventilated. This is done via the line 69 and the non-return valve 68. The air present at the inlet of the non-return valve 68 being saturated, the tank 40 is thus ventilated with saturated air, so that no uncontrolled vaporization can develop inside the tank 40.

Once the desired filling level is reached in the washing vessel 11, the filling process is interrupted by a sensor (not shown) in that the vacuum pump 65 is switched off, and the valve 29 is closed simultaneously.

It is understood in this connection that the filling process can be effected alternatively or additionally via the valve 32, the line 31 and the splash douche 30. In this case, the liquid 41 is drawn into the washing vessel 11 through the splash douche 30, the liquid 41 emerging from the splash douche 30 in the form of pressureless splash (arrows 34) so that the liquid flows about the workpieces 13 as the washing vessel 11 is being filled.

Preferably, the washing vessel 11 is filled up to a level above the overflow 45.

During a next phase of the flotation process, the valves 29, 32 and 47 are closed, while the valves 22, 59 and 71 are opened. Then the blower 23 is switched on, with the vacuum pump 65 switched off.

The blower 23 generates a gas pressure inside the hollow body 20 so that air bubbles will rise from the bottom inside the washing vessel 11 and the liquid 41, and will flow around the workpieces 13. The air blown into the washing vessel 11 is exhausted in this case via the line 51. From the line 51, the air travels through the condenser 53, the line 63, the line 70 and the open valve 71, to the exhaust 73. In this case, too, any separated condensed liquid is returned to the tank 40 via the collecting vessel 54, the line 58 and the valve 59.

The measures described above have detached dirt particles from the workpieces 13. These also include oils and fats which, due to their low specific gravity, collect at the surface of the liquid 41.

Upon termination of the flotation process, the blower 23 is switched off, and all valves are temporarily closed. Then the valve 47 is opened to activate the overflow 45 so that the liquid level inside the washing vessel 11 will drop until it reaches the height of the overflow 45. It is thus possible to skim the fat and oil content floating on the surface of the liquid 41, by means of the overflow 45.

For the vacuum boiling step, the liquid level is conveniently adjusted to shortly below the overflow 45. This can be effected for example by opening the valve 29 temporarily.

Now, all valves are closed, and the vacuum pump 65 is switched on. The vacuum pump 65 acts to generate a vacuum in the air space above the liquid 41 in the washing vessel 11, which vacuum is adjusted in such a way that the liquid 41 will start boiling already at a temperature of, say, 70° C. Such "vacuum cleaning", i.e. the vapor bubbles rising as a result thereof, leads to a cleaning effect for the workpieces 13. During this procedural step, the condensed liquid is again separated from the extracted vapor and is then, following the atmospheric pressure compensation, returned to the tank 40, as has been described several times before.

Finally, in order to empty the washing vessel 11, the valves 29 and 59 are opened, while all the other valves are closed. This causes the liquid 41 to flow from the washing vessel 11 through the connection 27, the valve 29 and the lines 28 and 33 and back into the tank 40. The air expelled from the tank 40 is guided via the valve 59, the line 58, the condensing means 52 and the line 51, into the interior of the washing vessel 11. Thus, complete balancing as regards the liquid 41 and the air is achieved between the washing vessel 11 and the tank 40.

I claim:

1. An apparatus for cleaning metallic workpieces prior to a subsequent heat treatment of said workpieces, the apparatus comprising:

a washing vessel having an interior space;

means for supporting workpieces, said supporting means being arranged within said washing vessel interior space;

a tank containing a cleaning liquid, said tank being arranged below said washing vessel;

first duct means directly interconnecting said washing vessel interior space and said tank;

first valve means arranged within said first duct means for opening and closing, respectively, said first duct means;

means for closing said washing vessel in an air-tight manner;

a vacuum pump;

second duct means interconnecting said vacuum pump and said washing vessel interior space;

means for introducing said workpieces into said washing vessel interior space;

control means having:

first switching means for closing said first valve means and switching on said vacuum pump when said workpieces have been introduced into said interior space and said washing vessel has been closed in said air-tight manner;

second switching means for subsequently opening said first valve means when a predetermined first sub-atmospheric pressure value is established within said washing vessel interior space, said predetermined first sub-atmospheric pressure value being set such that said cleaning liquid is drawn up from said tank into said washing vessel interior space until a predetermined liquid level is established within said washing vessel interior space;

third switching means for subsequently closing said first valve means and for switching on said vacuum pump until a predetermined second sub-atmospheric pressure value is established within said washing vessel interior space, said second predetermined sub-atmospheric pressure value being set such that said cleaning liquid boils at a temperature of between 50° C. and 90° C.;

fourth switching means for subsequently switching said vacuum pump off and for opening said first valve means to allow said cleaning liquid to drain down back into said tank; and fifth switching means for subsequently closing said first valve means and for switching on said vacuum pump until a predetermined third sub-atmospheric pressure value is established within said washing vessel interior space, said third sub-atmospheric pressure value being set such that said workpieces are vacuum-dried.

2. The apparatus according to claim 1, wherein said first duct means opens into said washing vessel in a bottom thereof.

3. The apparatus according to claim 1, wherein said first duct means opens into said washing vessel above said supporting means.

4. The apparatus according to claim 1, wherein condensing means is provided in said second duct means.

5. The apparatus according to claim 4, wherein said condensing means comprises a condensed liquid collecting vessel, third duct means being provided interconnecting said condensed liquid collecting vessel with said tank.

6. An apparatus for cleaning metallic workpieces prior to a subsequent heat treatment of said workpieces, the apparatus comprising:

a washing vessel having an interior space;

a support, located within said washing vessel interior space, for supporting a workpiece to be cleaned;

a tank containing a cleaning liquid, said tank being arranged below said washing vessel;

a first duct interconnecting said washing vessel interior space and said tank;

a valve, arranged with said first duct, for opening and closing, respectively, said first duct;

a vacuum pump;

a second duct interconnecting said vacuum pump and said washing vessel interior space;

a controller, connected to said vacuum pump and said valve, for operatively controlling said vacuum pump and said valve to create at least a partial vacuum within said washing vessel to thereby draw cleaning liquid up from said tank, through said first duct, and into said washing vessel.

7. The apparatus as set forth in claim 6, wherein said controller is further operable to control said vacuum pump and said valve to create a selected pressure in said washing vessel, to thereby cause said cleaning liquid within said washing vessel to boil.

8. The apparatus as set forth in claim 7, wherein said controller is further operable to control said vacuum pump to vacuum dry said workpiece.

9. An apparatus for cleaning metallic workpieces prior to a subsequent heat treatment of said workpieces, said apparatus comprising:

a washing vessel having an interior space;

a support, located within said washing vessel interior space, for supporting a workpiece to be cleaned;

a tank containing a cleaning fluid;

a first duct interconnecting said washing vessel interior space and said tank;

a valve, arranged with said first duct, for opening and closing, respectively, said first duct;

a vacuum pump;

a second duct interconnecting said vacuum pump and said washing vessel interior space;

a controller, connected to said vacuum pump and said valve, for operatively controlling said vacuum pump and said valve to create at least a partial vacuum within said washing vessel, to thereby draw cleaning liquid up from said tank, through said first duct, and into said washing vessel, and thereafter controlling said vacuum pump and said valve to achieve at least a selected pressure within said washing vessel, wherein said cleaning liquid within said washing vessel boils at said selected pressure.

10. An apparatus for cleaning metallic workpieces prior to a subsequent heat treatment of said workpieces, said apparatus comprising:

a washing vessel having an interior space;

a support, located within said washing vessel interior space, for supporting a workpiece to be cleaned;

a tank containing a cleaning fluid;

a first duct interconnecting said washing vessel interior space and said tank;

a valve, arranged with said first duct, for opening and closing, respectively, said first duct;

a vacuum pump;

a second duct interconnecting said vacuum pump and said washing vessel interior space;

a controller, connected to said vacuum pump and said valve, to achieve at least a selected pressure within said washing vessel, wherein said cleaning liquid boils at said selected pressure, said vacuum pump further operable to vacuum dry said workpiece.

11. An apparatus for cleaning metallic workpieces prior to a subsequent heat treatment of said workpieces, said apparatus comprising:

a washing vessel having an interior space;

a support, located within said washing vessel interior space, for supporting a workpiece to be cleaned;

a tank containing a cleaning fluid;

a first duct interconnecting said washing vessel interior space and said tank;

a valve, arranged with said first duct, for opening and closing, respectively, said first duct;

a vacuum pump;

a second duct interconnecting said vacuum pump and said washing vessel interior space;

a controller, connected to said vacuum pump and said valve, for operatively controlling said vacuum pump and said valve to create at least a partial vacuum within said washing vessel, to thereby draw cleaning liquid up from said tank, through said first duct, and into said washing vessel, said vacuum pump further operable to subsequently vacuum dry said workpiece.

* * * * *